US006017490A

United States Patent [19]

Otsuka et al.

[11] Patent Number: 6,017,490

[45] Date of Patent: Jan. 25, 2000

[54] PRESSED BODY OF AMORPHOUS MAGNETICALLY SOFT ALLOY POWDER AND PROCESS FOR PRODUCING SAME

[75] Inventors: Isamu Otsuka, Sakai; Isao Endo, Ikoma; Hideo Koshimoto, Nagaokakyo; Hiroshi Yamamoto, Higashiosaka; Ryosei Okuno, Amagasaki, all of Japan

[73] Assignee: Kubota Corporation, Osaka, Japan

[21] Appl. No.: 08/974,553

[22] Filed: Nov. 19, 1997

[30] Foreign Application Priority Data

| | | | |
|---|---|---|---|
| Nov. 26, 1996 | [JP] | Japan | 8-331546 |
| Sep. 17, 1997 | [JP] | Japan | 9-272192 |

[51] Int. Cl.[7] ..... B22F 1/02

[52] U.S. Cl. ..... 419/35; 148/100; 148/304; 75/246

[58] Field of Search ..... 419/35; 428/404, 428/570; 75/246; 148/100, 304

[56] References Cited

U.S. PATENT DOCUMENTS

| | | | |
|---|---|---|---|
| 4,601,765 | 7/1986 | Soileau et al. | 148/104 |
| 4,983,231 | 1/1991 | Yamanaka et al. | 148/301 |
| 5,026,419 | 6/1991 | Iwasaki et al. | 75/254 |
| 5,252,148 | 10/1993 | Shigeta et al. | 148/307 |

FOREIGN PATENT DOCUMENTS 0 302 355 2/1989 European Pat. Off. .

OTHER PUBLICATIONS

Database WPI, Section Ch, Week 8746, Derwent Publications Ltd., London, GB; Class L03, AN 87–325021, XP002054966 & JP 62 232 103 A(Hitachi Metals Ltd), Oct. 12, 1987.

Database WPI, Section Ch, Week 8824, Derwent Publications Ltd., London, GB; Class L03, AN 88–165373, XP002054967 & JP 63 104 408 A(Nippon Kinzoku Co Ltd), May 9, 1988.

Database WPI, Section Ch, Week 9217, Derwent Publications Ltd., London, GB; Class L03, AN 92–137434, XP002054968 & JP 04 079 302 A(Toshiba KK), Mar. 12, 1992.

*Primary Examiner*—Ngoclan Mai
*Attorney, Agent, or Firm*—Armstrong, Westerman Hattori, McLeland & Naughton

[57] ABSTRACT

A powder of composite particles is prepared by adhering to the surfaces of particles of an amorphous magnetically soft alloy particles of a glass having a softening point lower than the crystallization temperature of the alloy to coat the surfaces of the alloy particles with the glass. The powder of composite particles prepared is pressed at a temperature higher than the softening point of the glass and lower than the crystallization temperature of the alloy to bond the alloy particles with the glass. The pressed powder body is at least 0.5 in the ratio of the magnetic permeability at $10^7$ Hz to the magnetic permeability at $10^4$ Hz.

3 Claims, 6 Drawing Sheets

100 μm

PRESSED BODY OF AMORPHOUS MAGNETICALLY SOFT ALLOY POWDER AND PROCESS FOR PRODUCING SAME

FIELD OF THE INVENTION

The present invention relates to pressed powder bodies of amorphous magnetically soft alloy wherein a glass of low softening point is used, and to improvements in the process for preparing the pressed body.

BACKGROUND OF THE INVENTION

It is known that amorphous magnetically soft alloys exhibit more excellent characteristics than crystal materials in respect of corrosion resistance, wear resistance, strength, magnetic permeability, etc. These alloys are used as magnetic materials for various electric or electronic devices.

The amorphous magnetically soft alloy is generally in the form of a thin strip, thin wire or powder because of the reasons involved in the quenching process for assuring the amorphous state. Accordingly when members of specified shape are to be produced with use of such an alloy in the form of a thin strip or wire, the alloy is first pulverized into a powder and then pressed at a predetermined temperature into bodies of the specified shape.

The powder of amorphous magnetically soft alloy needs to be pressed at a temperature lower than the crystallization temperature of the alloy so as to retain the amorphous state. Since the alloy powder can not be bulked at this temperature, it is practice to mix a glass powder of low softening point with the alloy powder and to heat the mixture so as to bond the alloy particles with the glass.

However, if the amount of glass for use as a binder is excessive, the resulting body has impaired magnetic characteristics. The glass is therefore used generally in a small amount, whereas the alloy particles are then more likely to contact with one another to reduce the electric resistance of the pressed body and permit generation of eddy current between the particles, consequently lowering the magnetic permeability in the high frequency range. Further if used in an insufficient amount, the glass fails to satisfactorily bond the alloy particles to result in the drawback of lower mechanical strength.

To avoid the above problem, it is required to thoroughly mix the alloy powder and the glass powder together before pressing so that the glass as softened will uniformly cover the alloy particles during the pressing step.

Conventionally, the alloy powder and the glass powder are mixed together in a mixer, and the mixture is thereafter pressed hot. The mixer affords a substantially uniform mixture, which nevertheless becomes no longer uniform due to the difference in specific gravity when charged into a press die, so that the pressed body obtained includes portions wherein the glass is absent between the alloy particles. This entails the drawback that the alloy particles are not insulated from one another effectively to reduce the magnetic permeability in the high frequency range.

In addition to the pressing process described, the explosive process, impact gun process, etc. are available for bulking the powder of amorphous magnetically soft alloy, whereas these processes not only require a special apparatus for giving very great energy but also have the problem that the shaping step is complex and low in productivity.

In bulking a powder of amorphous magnetically soft alloy by heating at a predetermined temperature and pressing with use of a glass of low softening point as a binder, an object of the present invention is provide a process for producing a pressed powder body of amorphous magnetically soft alloy having high mechanical strength and less diminished in magnetic permeability in the high frequency range by bonding particles of the amorphous magnetically soft alloy to one another with the glass.

SUMMARY OF THE INVENTION

To fulfill the above object, the present invention provides a powder comprising composite particles prepared by adhering to the surfaces of particles of an amorphous magnetically soft alloy particles of a glass having a softening point lower than the crystallization temperature of the alloy to coat the surfaces of the alloy particles with the glass. The powder of composite particles thus prepared is pressed at a temperature higher than the softening point of the glass and lower than the crystallization temperature of the alloy to bond the alloy particles with the glass.

Stated more specifically, the powder of composite particles comprising amorphous magnetically soft alloy particles coated with a layer of glass is packed into a press die to a high density. When the die is heated, the glass softens, and the glass layers over the surfaces of the alloy particles become fluid. When the powder within the die is pressed in this state, the pressure presses the alloy particles, forcing fine particles into interstices between coarse particles and causing the fluid glass to move into the interstices between the alloy particles at the same time, whereby a pressed powder body is formed with the glass present between the alloy particles. When the pressed body is cooled, the glass solidifies to serve the function of a binder for the alloy powder and also the function of an insulator between the particles. The pressed body obtained therefore has great mechanical strength and the desired magnetic permeability characteristics. Since the heating temperature is lower than the crystallization temperature of the amorphous alloy, the alloy as pressed remains amorphous.

The pressed powder body prepared by the foregoing process is at least 0.5 in the ratio of the magnetic permeability at $10^7$ Hz to the magnetic permeability at $10^4$ Hz, hence excellent magnetic permeability characteristics.

DETAILED DESCRIPTION OF THE INVENTION

Preparation of Composite Particles of Amorphous Magnetically Soft Alloy and Glass Particles of an amorphous magnetically soft alloy are coated with a layer of glass of a low softening point by the following procedure to obtain composite particles.

Examples of useful amorphous magnetically soft alloys are Fe alloys (such as Fe-Si-B) and Co alloys (such as Co-Fe-Si-B). The crystallization temperature of these alloys are usually about 500° C.

The powder of amorphous magnetically soft alloy is prepared preferably by the high-speed rotating water stream process so that the particles have an outwardly curved round surface. With the high-speed rotating water stream process, the material alloy is melted at a temperature about 50 to 200° C. higher than the melting point thereof and then quenched at a high cooling rate of at least about $10^5$K/sec. It is a process for producing a metal powder by supplying a jet stream of molten metal to a cooling water layer flowing down the inner peripheral surface of a cooling cylinder while whirling to divide the metal stream with the whirling cooling water layer and quench the metal for solidification (see Japanese Pre-examination publication HEI 4-17605).

Alternatively, the powder of amorphous magnetically soft alloy can be produced, for example, by the rotating liquid atomizing process with use of rotary drum.

Figure 3A:
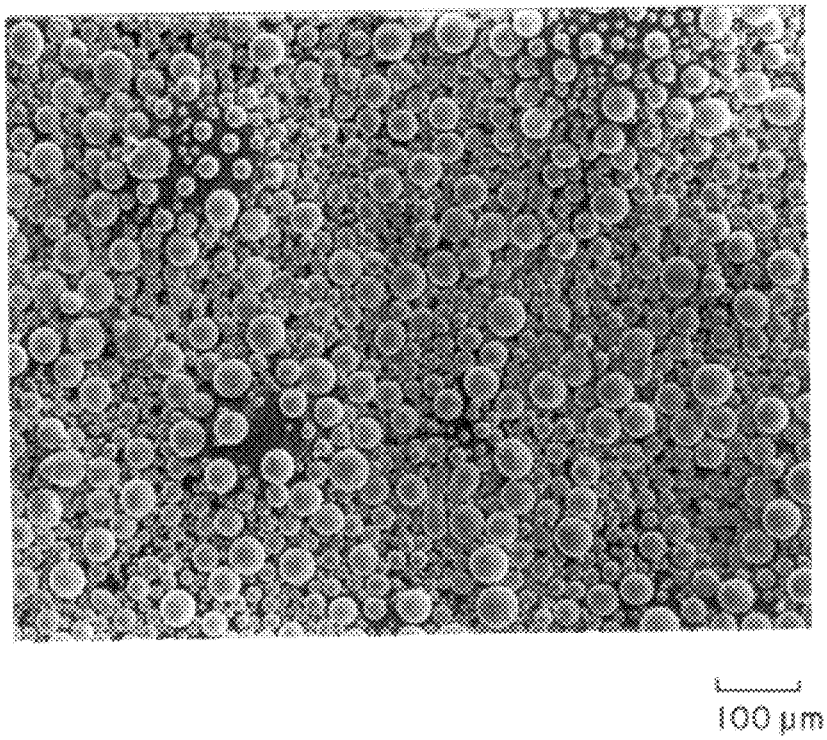
FIG. 3 includes photographs showing the appearance of amorphous alloy particles prepared by the high-speed rotating water stream process.
Figure 3B:
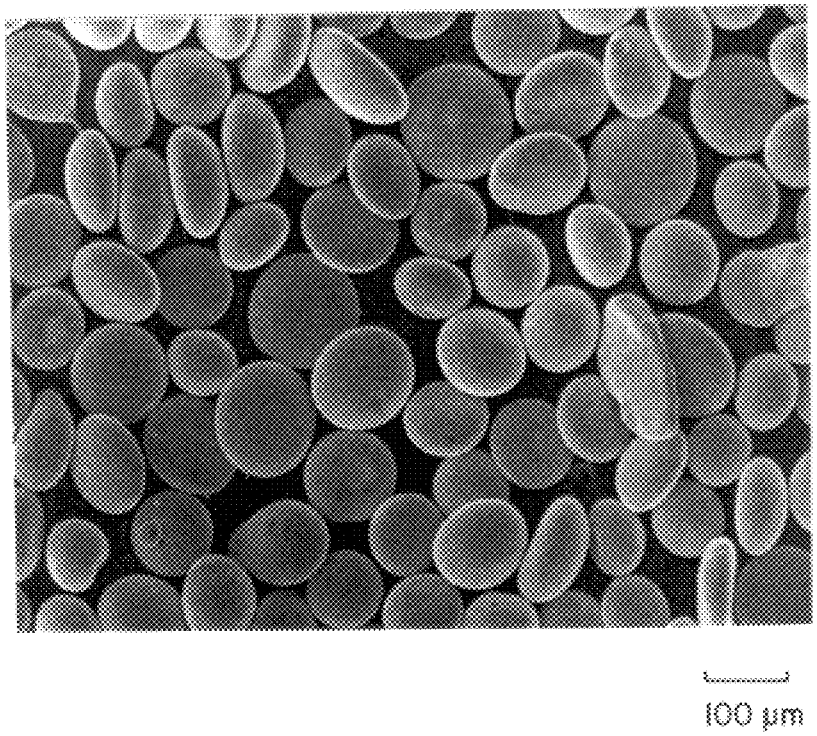
Figure 3C:
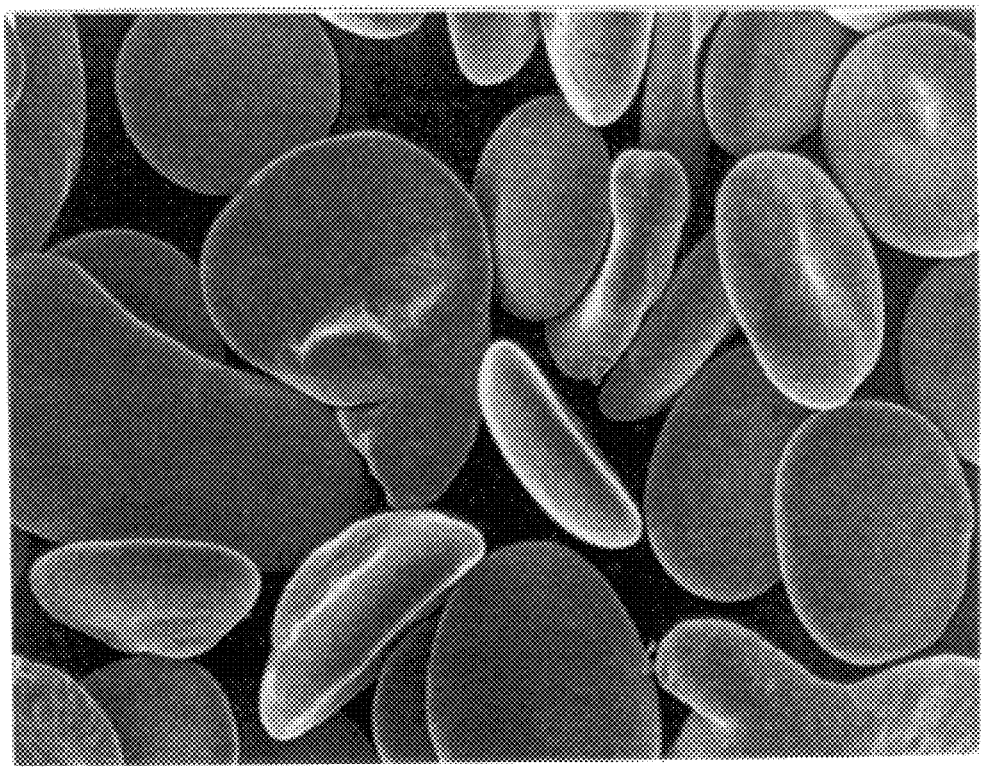

When the high-speed rotating water stream process is resorted to, the particles of amorphous magnetically soft alloy are so shaped that the smaller the particles, the closer to true spheres are the particles, and that coarser particles become flat or similar to tear drops as seen in FIG. 3. With reference to FIG. 3 showing the shape of amorphous magnetically soft alloy powders, photograph (A) shows particles up to about 44 micrometers in diameter, photograph (B) shows particles of about 74 to about 105 micrometers in diameter, and photograph (C) shows particles of about 149 to about 210 micrometers in diameter.

The particles of (A), (B) and (C) are about 1 to about 2, about 2 to about 4, and about 3 to about 5, respectively, in aspect ratio. To obtain a pressed body of high magnetic permeability, it is desired to use particles of amorphous magnetically soft alloy which are about 2 to about 5 in average aspect ratio because the closer to true spheres the particles are, the greater is the influence of the diamagnetic field to lower the magnetic permeability of the pressed body in its entirety.

The term aspect ratio refers to the ratio of the long diameter of the alloy particle to the short diameter thereof, and an aspect ratio approximate to 1 indicates that the particle closely resembles a true sphere.

The glass to be used has a softening point lower than the crystallization temperature of the amorphous magnetically soft alloy. For example, the softening point is preferably about 100 to about 200° C. lower so as to widen the range of temperatures for pressing the alloy powder.

Examples of suitable glass materials are those having a low softening point such as borate glass containing lead oxide ($PbO.B_2O_3$).

The particle size of the glass powder is suitably selected in accordance with the size of amorphous magnetically soft alloy particles used. For example, when the alloy powder is about 100 to about 150 micrometers in particle size, the glass powder is preferably about 3 to about 7 micrometers in particle size. In the case where the alloy powder is about 50 about 100 micrometers in particle size, it is desirable to use a glass powder which is about 1 to about 5 micrometers in particle size.

It is desired that the glass power be used in an amount of 3 to 20 vol. % based on the mixture. If the amount of glass is insufficient, the glass will not act effectively as a binder, presenting difficulty in bulking the alloy powder. With an excess of glass present, the alloy particles are bonded satisfactorily to give increased mechanical strength, whereas the proportion of the alloy in the pressed body then becomes smaller to entail the likelihood that the pressed body will not have the desired magnetic characteristics.

FIG. 4 shows an example of apparatus for use in preparing the powder of composite particles comprising amorphous magnetically soft alloy particles coated with a glass layer. The drawing is a side view in section (taken along a direction orthogonal to the axis of a hollow cylindrical container 10 at a position close to one end thereof).

With reference to FIG. 4, the cylindrical container 10, which is closable, has inside thereof a rotary shaft 20 fixedly provided with a boss 11. A first arm 12 radially projecting from the boss 11 is formed with a shoelike press member 14 extending axially of the container 10. The outer end face of the press member 14 is spaced apart from the inner surface of the container by a predetermined clearance so that the powder can be pressed or compressed by the member. The boss 11 has a second arm 16 radially projecting therefrom in a direction opposite to the first arm 12. The second arm 16 is formed at its outer end with a scraper 18 in the form of a slender plate and extending axially of the container 10. The scraper is nearly in contact with the container inner surface so as to scrape off the powder 22. The container 10 can be given a vacuum or an inert gas atmosphere.

Figure 4A:
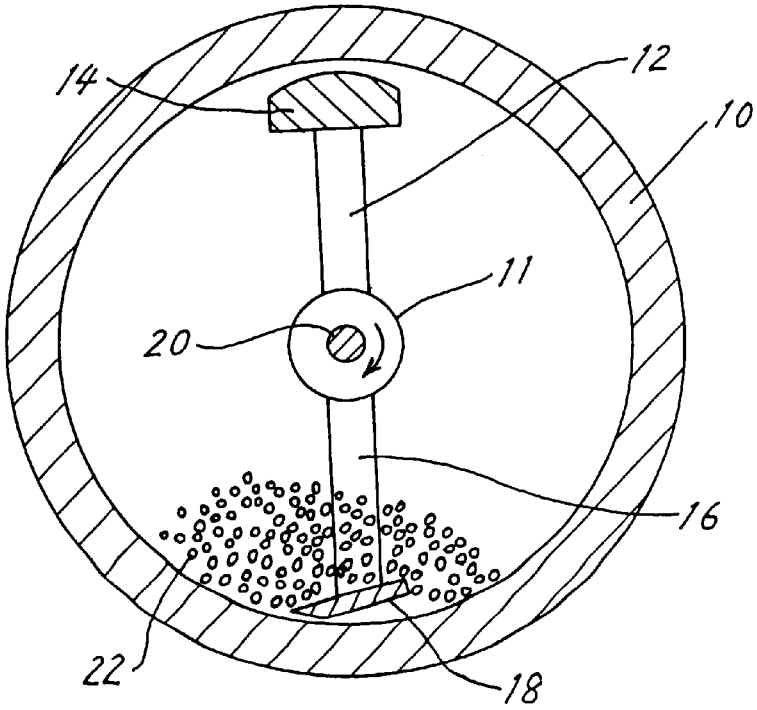
FIG. 4 includes side views in section for illustrating an apparatus for preparing composite particles from amorphous magnetically soft alloy particles and glass particles.
Figure 4B:
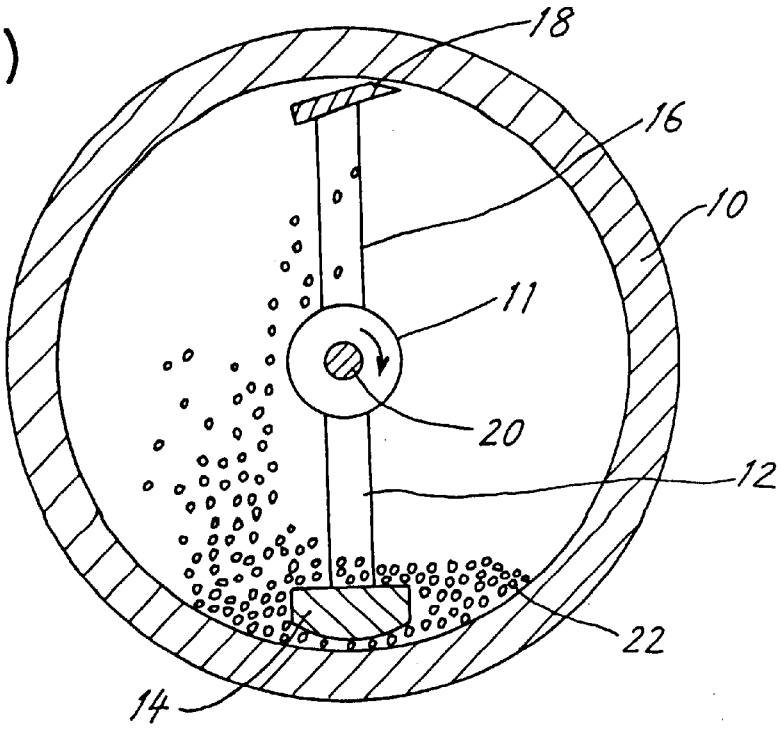

The rotary shaft 20 is coupled to a rotating drive device (not shown), rendering the first arm 12 and the second arm 16 rotatable at a high speed along with the shaft 20. FIG. 4(A) shows the scraper 16 as located in the lowermost position, and FIG. 4(B) shows the press member 14 as located in the lowermost position.

The composite particles of the present invention are prepared in the following manner with use of the apparatus.

Figure 5:
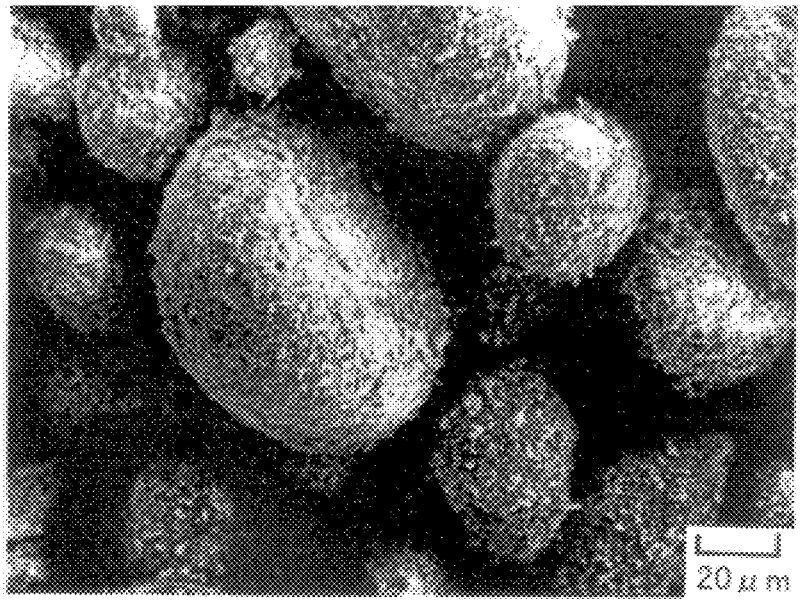
FIG. 5 is a photograph showing the appearance of composite particles of the invention prepared by coating the surfaces of amorphous magnetically soft alloy particles with a glass layer.
Figure 6:
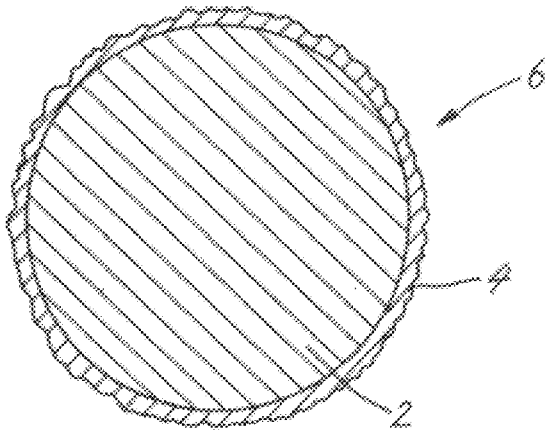
FIG. 6 is a diagram schematically showing the composite particle shown in FIG. 5.

A powder of amorphous magnetically soft alloy 2 and glass powder 22 are placed into the container 10, and stirred by being scraped off by the scraper 16. The powders are then pressed by the press member 14 against the inner peripheral surface of the container 10 and thereby subjected to an intense compressive frictional action. The powders are thus acted on repeatedly at a high speed, whereby the alloy particles and the glass particles are fused over their surfaces, with the glass particles also fused to one another. Consequently, the amorphous magnetically soft alloy particles 2 are coated with a layer 4 of the glass to give composite particles 6 as seen in FIG. 6. FIG. 5 shows the appearance of some of these composite particles 6.

Preferably, the glass layer is up to about 3 micrometers in thickness because if the thickness exceeds 3 micrometers, the glass layer is liable to chip and become uneven in thickness to result in impaired insulation.

To prevent oxidation, the composite particles are prepared in an inert gas atmosphere or vacuum. A vacuum is preferably used because no gas molecules are then present which will hamper solid-solid bonding, consequently promoting formation of composite particles.

Particles of amorphous magnetically soft alloy, $Fe_{78}Si_9B_{13}$, and a powder of glass, $PbO.B_2O_3$, were made into composite particles in the same manner as above. The particles were checked for coercive force before and after the preparation procedure using a vibrating sample magnetometer (VSM). The alloy particles used as the material were about 1 oersted (Oe), while the measurement of the composite particles was the same, i.e., about 1 Oe. Thus, the alloy particles remained unchanged in coercive force when made into the composite particles, retaining the original excellent amorphous magnetically soft characteristics.

The powder of composite particles comprising amorphous magnetically soft alloy particles coated with a layer of glass can alternatively be prepared by the plasma process, sol-gel process or other process.

When the particulate composite material of the invention was allowed to stand at a temperature of 60° C. and relative humidity of 80% for 1000 hours, the particles were found to be free of any oxidation over the surfaces thereof, whereas when particles of amorphous magnetically soft alloy were allowed to stand in the same environment for the same period of time, the particle surfaces were found to be seriously oxidized.

Thus, the glass coating over the surfaces of amorphous magnetically soft alloy particles prevents the oxidation of the alloy surfaces. Accordingly the powder of composite particles can be stored favorably since there is no need to preserve the powder in a non-oxidizing atmosphere.

Preparation of Pressed Powder Body of Amorphous Alloy

The powder of composite particles of amorphous magnetically soft alloy and glass prepared by the above procedure is pressed using, for example, a hot press at a temperature higher than the softening point of the glass and lower than the crystallization temperature of the alloy, whereby the material powder can be bulked to obtain a pressed powder body. The pressing process is not always limited to the use of the hot press; hot isostatic pressing process (HIP) can of course be usable.

For example, an amorphous Fe alloy, Fe-Si-B, having a crystallization temperature of about 500° C. and a borate glass having a softening point of about 320° C. can be pressed into a body at a temperature of about 400 to about 480° C. under a pressure of about 1 to about 2 GPa for about 1 minute.

With the pressed body produced by such a process, the glass present between the particles of amorphous magnetically soft alloy serves as a binder to give the desired mechanical strength and also as an insulator between the alloy particles to entail the advantage of a reduced power loss due to eddy current and diminished reduction of the magnetic permeability in the high frequency range.

When the pressed powder body of amorphous magnetically soft alloy of the invention is to be used as the magnetic core of choke coil or flyback transformer, it is desired that the body be further machined to the finished configuration and heated again at a temperature lower than the crystallization of the alloy and higher than the softening point of the glass for the relief of strain. It is suitable that the finished body be held heated for about 10 to about 20 minutes.

Even if the powder of amorphous magnetically soft alloy develops mechanical strain during pressing, the strain relief heat treatment thus conducted heats the glass again at a temperature higher than the softening point thereof, relieving the alloy of the restraint of the glass to remove the strain. This restores the magnetic characteristics which have been impaired by the strain, enabling the pressed body to retain the original characteristics of the alloy to the greatest possible extent. The magnetic core therefore exhibits excellent magnetic characteristics.

EXAMPLES

Invention Example 1

A powder of amorphous magnetically soft alloy, $Fe_{78}Si_9B_{13}$ (about 300 micrometers in maximum particle size, about 65 micrometers in mean particle size and about 3 in average aspect ratio), and a powder of $PbO.B_2O_3$ (3 micrometers in mean particle size) were mixed together in a ratio of 95:5 (by volume) and treated by the apparatus shown in FIG. 4 to prepare a powder of composite particles comprising the alloy particles serving as the base particles and coated with a layer of the glass. The alloy particles included flat particles, particles resembling tear drops and spherical particles in mixture. The composite particles obtained were about 65 micrometers in the average diameter of the alloy particles and about 2 micrometers in the thickness of the glass layer.

The powder of composite particles obtained was then pressed hot at a temperature of 450° C. under a pressure of 1.6 GPa for about 0.5 minute to obtain a specimen body 20 mm in diameter and 10 mm in length. The specimen body was further heat-treated at a temperature of 500° C. for the relief of stress.

Invention Example 2

A powder of amorphous magnetically soft alloy, $Fe_{78}Si_9B_{13}$ (about 44 micrometers in maximum particle size, about 20 micrometers in mean particle size and about 1 in average aspect ratio), and a powder of $PbO.B_2O_3$ (3 micrometers in mean particle size) were mixed together in a ratio of 95:5 (by volume) and made into composite particles of the alloy and glass in the same manner as in Invention Example 1. Almost all the alloy particles were nearly spherical. The composite particles were about 65 micrometers in average diameter of the alloy particles and about 2 micrometers in the thickness of the glass layer.

The powder of composite particles obtained was pressed hot and heat-treated for the removal of stress in the same manner as in Invention Example 1 to prepare a specimen body.

Comparative Example 1

A powder of amorphous magnetically soft alloy, $Fe_{78}Si_9B_{13}$ (about 300 micrometers in maximum particle size, about 65 micrometers in mean particle size and about 3 in average aspect ratio), and a powder of $PbO.B_2O_3$ (3 micrometers in mean particle size) were mixed together in a ratio of 95:5 (by volume) and agitated in a ball mill to obtain a powder in the form of a substantially uniform mixture of the alloy powder and glass powder. The alloy particles included flat particles, particles resembling tear drops and spherical particles in mixture.

The mixture powder obtained was pressed hot and heat-treated for the removal of stress in the same manner as in Invention Example 1 to prepare a specimen body.

Measurement and Evaluation of Magnetic Permeability

Figure 7:
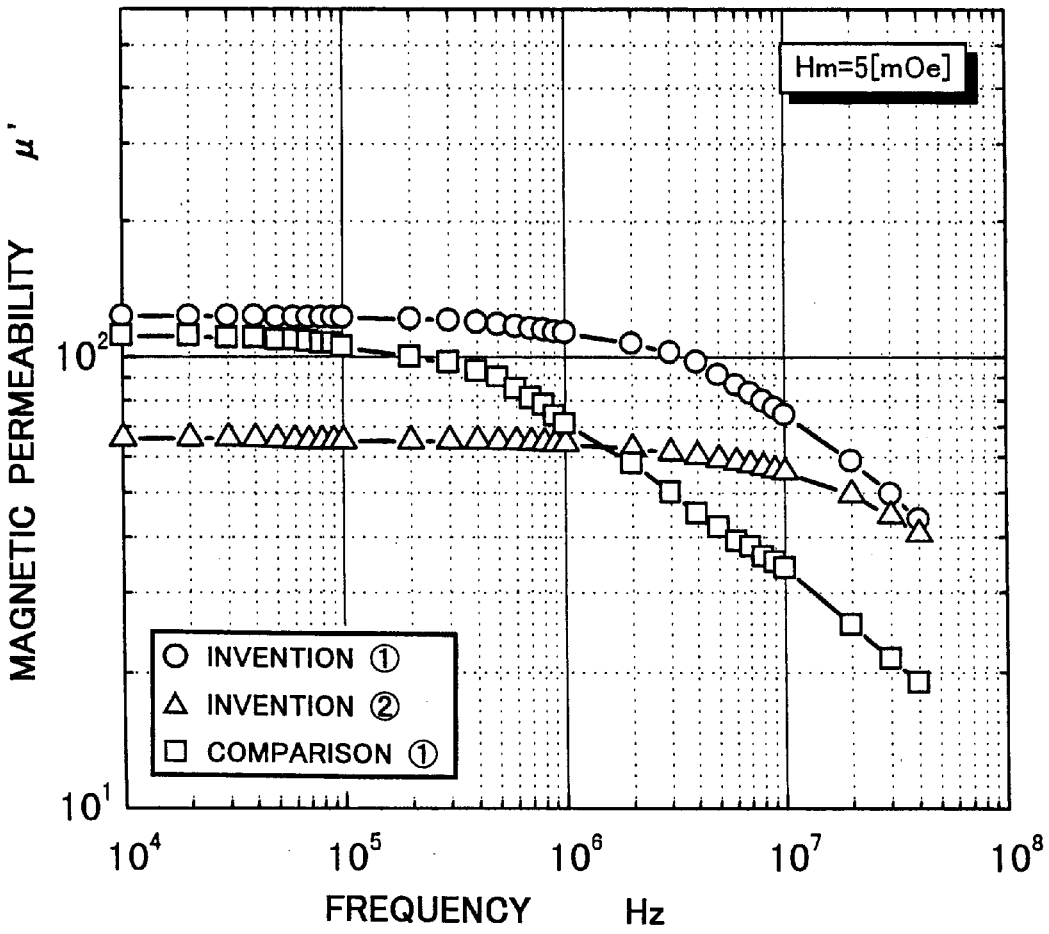
FIG. 7 is a graph showing the results obtained by measuring the magnetic permeability of pressed body specimens.

The specimen bodies obtained were checked for magnetic permeability under the measuring condition of Hm=5 mOe. FIG. 7 shows the results.

With reference to FIG. 7, Invention Example 1 is 123 in magnetic permeability at $10^4$ Hz, 74.5 in magnetic permeability at $10^7$ Hz and therefore 0.6 in the ratio of the magnetic permeability at $10^7$ Hz to the magnetic permeability at $10^4$ Hz. Thus, the reduction of the permeability in the high frequency range is small.

Invention Example 2 is 66 in magnetic permeability at $10^4$ Hz, 55.5 in magnetic permeability at $10^7$ Hz and therefore 0.84 in the ratio of the magnetic permeability at $10^7$ Hz to the magnetic permeability at $10^4$ Hz. Thus, the reduction of the permeability in the high frequency range is smaller than is the case with Invention Example 1.

In contrast, Comparative Example 1 is 111 in magnetic permeability at $10^4$ Hz, 35 in magnetic permeability at $10^7$ Hz and therefore 0.32 in the ratio of the magnetic permeability at $10^7$ Hz to the magnetic permeability at $10^4$ Hz. Thus, the reduction of the permeability in the high frequency range is great.

A comparison between Invention Example 1 and Invention Example 2 indicates that the former is greater in magnetic permeability. This is related to the aspect ratio of the alloy particles; Invention Example 2 which is great in the amount of spherical particles and has a small aspect ratio is greatly influenced by the diamagnetic field and is therefore diminished in magnetic permeability. Accordingly, it is desirable to use amorphous magnetically soft alloy particles having an average aspect ratio of 2 to 5 for uses in which high permeability is required.

Figure 1:
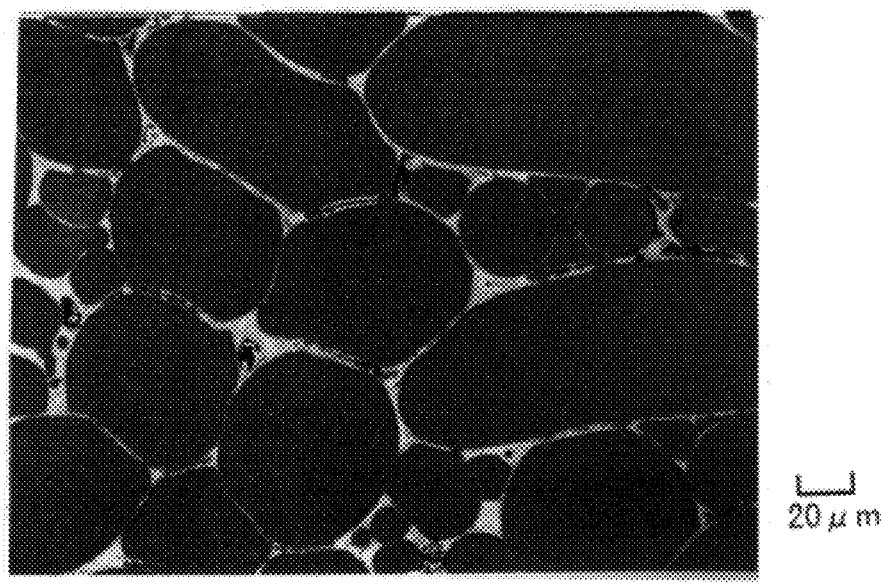
FIG. 1 is a photograph showing the microstructure of pressed body of Invention Example 1.
Figure 2:
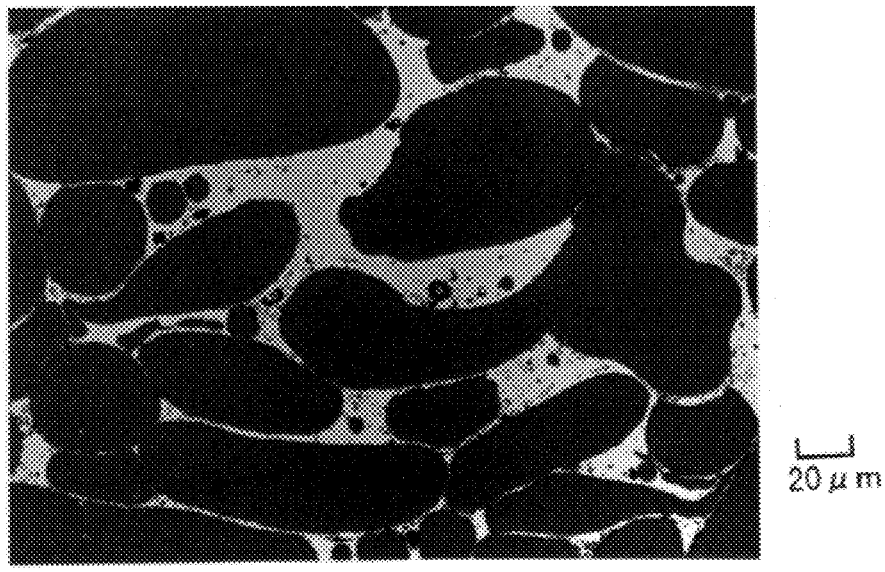
FIG. 2 is a photograph showing the microstructure of pressed body of Comparative Example 1.

FIGS. 1 and 2 show the microstructures of the specimen pressed bodies of Invention Example 1 and Comparative Example 1, respectively. The photographs show black areas which are alloy particles and white areas which are the glass. The surfaces of alloy particles of Invention Example 1 shown in FIG. 1 are bonded to one another with a thin glass film formed therebetween, whereas the alloy particles of Comparative Example 1 shown in FIG. 2 have several portions where the glass film is absent. At these portions, the particles are not insulated from each other, permitting generation of eddy current to result in lower magnetic permeability in the high frequency range.

When checked by X-ray diffraction pattern, the specimen bodies of Invention Examples 1 and 2, and Comparative Example 1 were all found to be amorphous.

The particulate composite material of the present invention comprising amorphous magnetically soft alloy particles coated with a glass layer is favorably usable for preparing pressed powder bodies of amorphous magnetically soft alloys, for example, by a hot press or HIP. The power bodies obtained comprise particles of amorphous magnetically soft alloy which are effectively bonded by a thin glass film. These pressed bodies have specified mechanical strength, are satisfactory in insulation between the particles, reduced in eddy current loss and diminished in frequency dependence, possess flat magnetic permeability even in the high frequency range, and are suitable for use as magnetic materials for various electric or electronic devices.

In the case where pressed powder bodies of the invention are to be used for high-frequency power devices, the body needs to have a high alloy density to obtain a magnetic permeability of not lower than a specified level, so that a smaller amount of glass powder is mixed with the alloy. On the other hand, when the pressed powder body is to be applied to uses wherein insulation between the particles is considered to be important to ensure a diminished eddy current loss, an increased amount of glass powder is used so that the glass serves as the insulator.

The present invention is not limited to the foregoing embodiments but can be modified variously without departing from the scope of the invention as defined in the appended claims.

What is claimed is:

1. A process for producing a pressed powder body of an amorphous magnetically soft alloy, the process comprising the steps of:

preparing particles of amorphous magnetically soft alloy and particles of glass, the glass having a softening point lower than crystallization temperature of the alloy;

subjecting the particles of the alloy and the glass to a compressive frictional action, in order for the glass particles to be fused over the surfaces of the alloy particles, thereby making a powder of composite particles of amorphous magnetically soft alloy and glass wherein the alloy is coated with a layer of the glass, in thickness of up to about 3 micrometers; and pressing the powder of composite particles at a temperature higher than the softening point of the glass and lower than the crystallization temperature of the alloy, thereby bonding the alloy particles with the glass.

2. A pressed powder body comprising:

particles of an amorphous magnetically soft alloy glass binding the particle, the glass having a softening point lower than crystallization temperature of the alloy, wherein the pressed powder body being produced by a process comprising the steps of:

preparing particles of amorphous magnetically soft alloy and particles of glass;

subjecting the particles of the alloy and the glass to a compressive frictional action, in order for the glass particles to be fused over the surfaces of the alloy particles, thereby making a powder of composite particles of amorphous magnetically soft alloy and glass wherein the alloy is coated with a layer of the glass, in thickness of up to about 3 micrometers; and pressing the powder of composite particles at a temperature higher than the softening point of the glass and lower than the crystallization temperature of the alloy;

the pressed powder body being at least 0.5 in the ratio of magnetic permeability at $10^7$ Hz to the magnetic permeability at $10^4$ Hz.

3. A composite particle of an amorphous magnetically soft alloy and a glass, the composite particle being made by the process comprising the steps of:

preparing particles of the amorphous magnetically soft alloy and particles of the glass having a softening point lower than crystallization temperature of the alloy, and then subjecting the particles of the alloy and the glass to a compressive frictional action, wherein the particle of the amorphous magnetically soft alloy being coated over the surface thereof with a layer of the glass, in thickness of up to about 3 micrometers.

* * * * *

UNITED STATES PATENT AND TRADEMARK OFFICE
Certificate

Patent No. 6,017,490 B1 Patented: January 25, 2000

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Isamu Otsuka, Sakai, Japan; Isao Endo, Ikoma, Japan; Hideo Koshimoto, Nagaokakyo, Japan; Hiroshi Yamamoto, Higashiosaka, Japan; Ryosei Okuno, Amagasaki, Japan; and Masaaki Yagi, Kumamoto, Japan Signed and Sealed this Eighth Day of January 2002.

ROY V. KING
*Supervisory Patent Examiner*
Art Unit 1742